US007310093B2

(12) United States Patent
Kasai

(10) Patent No.: US 7,310,093 B2
(45) Date of Patent: Dec. 18, 2007

(54) CURRENT GENERATING CIRCUIT, ELECTRO-OPTICAL APPARATUS, AND ELECTRONIC UNIT

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 682 days.

(21) Appl. No.: 10/773,334

(22) Filed: Feb. 9, 2004

(65) Prior Publication Data

US 2004/0222986 A1 Nov. 11, 2004

(30) Foreign Application Priority Data

Feb. 28, 2003 (JP) ..... 2003-054012

(51) Int. Cl.
*G09G 5/00* (2006.01)

(52) U.S. Cl. ..... 345/204; 345/87; 345/89; 345/98; 345/100; 345/211; 345/213; 345/76; 345/88; 345/82; 323/315

(58) Field of Classification Search ..... 345/76–83, 345/211–213, 204, 88, 98, 100
See application file for complete search history.

(56) References Cited

U.S. PATENT DOCUMENTS 4,446,419 A * 5/1984 van de Plassche et al. . 323/316
5,714,968 A 2/1998 Ikeda
5,926,062 A * 7/1999 Kuroda ..... 327/538
6,633,136 B2 * 10/2003 Kim et al. ..... 315/169.3
6,756,738 B2 * 6/2004 Maede et al. ..... 315/169.1
7,102,600 B2 * 9/2006 Kasai ..... 345/77

FOREIGN PATENT DOCUMENTS

JP A-01-220580 9/1989
JP A-01-303807 12/1989
JP A 11-220372 8/1999
JP A 2000-122608 4/2000
JP A-2003-288051 10/2003

* cited by examiner

*Primary Examiner*—Richard Hjerpe
*Assistant Examiner*—Jennifer T Nguyen
(74) *Attorney, Agent, or Firm*—Oliff & Berridge, PLC

(57) ABSTRACT

The invention provides a simple circuit configuration that can convert a current $I_1$ to a current $I_2$ having smooth, non-linear characteristics. The invention can include first and second resistors having one end of each of the resistors, whose resistances are different, connected to a power supply terminal to which a power supply voltage is supplied. The source of a first transistor can be coupled to the other end of the resistor, and is also connected to a gate in a saturating manner. The source of a second transistor is connected to the other end of the other resistor, and a gate of the second transistor is coupled to the gate of the first transistor, which is connected to a drain thereof in a saturating manner. The current $I_2$ flowing in a second transistor is a function equal to the square of the current $I_1$ flowing in the first transistor, thereby exhibiting smooth, non-linear characteristics.

16 Claims, 18 Drawing Sheets

$$\sqrt{\frac{2I_1}{\beta_i}} = V_2 - I_1 \bullet R_1 + I_2 \bullet R_2 - V_3 - V_{th}$$

$$\therefore I_1 \bullet R_1 - I_2 \bullet R_2 + \sqrt{\frac{2I_1}{\beta_1}} = V_2 - V_3 - V_{th} \cdots\cdots (7)$$

FIG.7

$$I_2 = \frac{1}{2}\beta_2\left(I_1 \bullet R_1 - I_2 \bullet R_2 + \sqrt{\frac{2I_1}{\beta_1}}\right)^2$$

$$\therefore \frac{2I_2}{\beta_2} = (I_1 \bullet R_1 - I_2 \bullet R_2)^2 + 2(I_1 \bullet R_1 - I_2 \bullet R_2)\sqrt{\frac{2I_1}{\beta_1}} + \frac{2I_1}{\beta_1}$$

$$= I_1^2 \bullet R_1^2 - 2I_1 \bullet R_1 \bullet I_2 \bullet R_2 + I_2^2 \bullet R_2^2 + 2I_1 \bullet R_1\sqrt{\frac{2I_1}{\beta_1}} - 2I_2 \bullet R_2\sqrt{\frac{2I_1}{\beta_1}} + \frac{2I_1}{\beta_1}$$

$$\therefore \quad R_2^2 \bullet I_2^2 - 2\left(\frac{1}{\beta_2} + I_1 \bullet R_1 \bullet R_2 + R_2\sqrt{\frac{2I_1}{\beta_1}}\right)I_2 + \left(\sqrt{\frac{2I_1}{\beta_1}} + I_1 \bullet R_1\right)^2 = 0 \cdots\cdots (8)$$

FIG.8

$$I_2 = \frac{\frac{1}{\beta_2} + I_1 \bullet R_1 \bullet R_2 + R_2\sqrt{\frac{2I_1}{\beta_1}} + \sqrt{\left(\frac{1}{\beta_2} + I_1 \bullet R_1 \bullet R_2 + R_2\sqrt{\frac{2I_1}{\beta_1}}\right)^2 - R_2^2\left(\sqrt{\frac{2I_1}{\beta_1}} + I_1 \bullet R_1\right)^2}}{R_2^2} \quad \cdots (9)$$

FIG.9

$$I_2 = \frac{1}{2}\beta_2\left(\sqrt{\frac{2I_1}{\beta_1}} + I_1 \bullet R_1\right)^2 \cdots\cdots (10)$$

CURRENT GENERATING CIRCUIT, ELECTRO-OPTICAL APPARATUS, AND ELECTRONIC UNIT

BACKGROUND OF THE INVENTION

1. Field of Invention

The present invention relates to a current generating circuit, an electro-optical apparatus, and an electronic unit that are suitable for use in driving display panels, for example, organic EL (Electronic Luminescence) panels.

2. Description of Related Art

Organic EL panels are attracting attention as next-generation display panels. The reason for this is that organic EL devices used in organic EL panels are self-light-emitting devices, as opposed to liquid crystal devices used in liquid crystal panels that merely change the amount by which the liquid crystal devices transmit light. The organic EL panels also exhibit excellent characteristics, for example, a wider viewing angle, a higher contrast, and a faster response speed than those of the liquid crystal panels. Unlike the liquid crystal devices, which are voltage-driven devices, the organic EL devices are so-called "current-driven devices." Accordingly, for driving the organic EL devices, instead of a voltage, a current should be generated in accordance with the grayscale (luminance) level, and thus, a current generating D/A converter has been invented. (See, for example, Japanese Unexamined Patent Application Publication No. 2000-122608.)

It is generally known that the humans' visual characteristics have logarithmic or exponential properties. Even if the grayscale changes linearly, it does not sometimes appear to the humans' eyes that the grayscale changes linearly. In view of these circumstances, it is common that non-linear characteristics (γ characteristics), for example, logarithmic or exponential characteristics, are provided in an electro-optical apparatus so that they appear to be linear characteristics for the humans' eyes. This type of processing is sometimes referred to as γ correction.

The following operation can be considered when taken this γ correction into consideration. A current signal having non-linear characteristics is generated for digital data indicating that the grayscale (luminance) of organic EL devices is linear, and is then provided to the organic EL devices, thereby allowing an observer to visually recognize that the grayscale changes linearly.

As the above type of operation, the following operations, for example, can be considered: (1) digital data having linear characteristics is converted into digital data having non-linear characteristics by using a table; and (2) the grayscale range represented by digital data is divided into a plurality of areas, and in the divided areas, required γ characteristics are approximated by using a plurality of linear characteristics.

SUMMARY OF THE INVENTION

However, the above operation (1) makes the circuit complicated, and the above operation (2) makes it difficult to obtain smooth γ characteristics. In view of this background, it is an object of the present invention to provide a current generating circuit having a simple circuit configuration and obtaining smooth, non-linear characteristics (γ characteristics), and also to provide an electro-optical apparatus and an electronic unit using such a current generating circuit.

A current generating circuit of the present invention can include a first resistor and a second resistor, one end of each of the first resistor and the second resistor being connected to a power supply terminal to which a power supply voltage is supplied, and the resistance of the first resistor and the resistance of the second resistor being different. Further, a first transistor for allowing a current corresponding to the voltage of the gate of the first transistor to flow between a first terminal and a second terminal of the first transistor, the first terminal being connected to the other end of the first resistor, and the second terminal and the gate being connected with each other, and a second transistor for allowing a current corresponding to the voltage of the gate of the second transistor to flow between a first terminal and a second terminal of the second transistor, can be provided with the first terminal being connected to the other end of the second resistor, and the gate of the second transistor being connected to the gate of the first transistor. The current flowing in the first transistor is converted into the non-linear current flowing in the second transistor. According to the present invention, the circuit configuration can be simplified, and also, smooth, non-linear characteristics can be obtained.

For the first and second resistors, it is sufficient that the resistances thereof are different, and accordingly, it is sufficient that the line width or the line length thereof is different. If the resistance of the first resistor is not zero, the resistance of the second resistor may be zero.

Another current generating circuit of the present invention can include a first resistor and a second resistor, one end of each of the first resistor and the second resistor being connected to a power supply terminal to which a power supply voltage is supplied, the resistance of the first resistor and the resistance of the second resistor being different, and at least one of the first resistor and the second resistor being a variable resistor. Further, a first transistor for allowing a current corresponding to the voltage of the gate of the first transistor to flow between a first terminal and a second terminal of the first transistor, the first terminal being connected to the other end of the first resistor, and the second terminal and the gate being connected with each other, and a second transistor for allowing a current corresponding to the voltage of the gate of the second transistor to flow between a first terminal and a second terminal of the second transistor, can be provided with the first terminal being connected to the other end of the second resistor, and the gate of the second transistor being connected to the gate of the first transistor. According to the present invention, the circuit configuration can be simplified, and also, smooth, non-linear characteristics can be obtained.

Between the first resistor and the second resistor, only the first resistor may preferably be a variable resistor. With this arrangement, the non-linear characteristics can be adjusted. The variable resistor may preferably be configured such that a plurality of resistor devices having predetermined resistances are connected in series with each other or in parallel with each other.

The above-described current generating circuits may be cascade-connected, and the current flowing in the second transistor of the current generating circuit disposed at the first stage may be allowed to flow in the first transistor of the current generating circuit disposed at the second stage.

The current generating circuit may further include a D/A conversion circuit for converting digital data into a current signal indicating a current corresponding to the digital data and for allowing the current signal to flow in the first transistor.

In order to achieve the above-described object, an electro-optical apparatus of the present invention can include pixel circuits disposed at the intersections of a plurality of scanning lines and a plurality of data lines, a scanning-line drive circuit for selecting the scanning lines; and a data-line drive circuit including the current generating circuit set forth above, and supplying the current flowing in the second transistor of the current generating circuit to the data lines. The pixel circuit disposed at the intersection between one scanning line and one data line can include a capacitor device for storing electrical charge in accordance with the current flowing in the one data line when the one scanning line is selected by the scanning-line drive circuit, and an electro-optical device in which a current corresponding to the electrical charge stored in the capacitor device flows when the selection of the one scanning line is finished. According to the present invention, the circuit configuration for obtaining non-linear characteristics can be simplified, and also, smooth, non-linear characteristics can be obtained.

This electro-optical apparatus may preferably include a setting circuit for setting the resistance of the first resistor or the second resistor of the current generating circuit to a desired value.

Another electro-optical apparatus of the present invention can include a plurality of types of pixel circuits corresponding to a plurality of primary colors, the pixel circuits corresponding to the same primary color being disposed at the intersections of a plurality of scanning lines and a plurality of data lines such that the pixel circuits share the same data line, a scanning-line drive circuit for selecting the scanning lines, and a data-line drive circuit including the current generating circuit set forth above for each of the primary colors, and supplying the current flowing in the second transistor of the current generating circuit corresponding to one primary color to the data line corresponding to the primary color. The pixel circuit disposed at the intersection between one scanning line and one data line can include a capacitor device for storing electrical charge in accordance with the current flowing in the data line when the scanning line is selected by the scanning-line drive circuit, and an electro-optical device in which a current corresponding to the electrical charge stored in the capacitor device flows when the selection of the scanning line is finished. According to the present invention, the circuit configuration for obtaining non-linear characteristics can be simplified, and also, smooth, non-linear characteristics can be obtained.

This electro-optical apparatus may preferably include a setting circuit for setting the resistance of the first resistor or the second resistor of the current generating circuit for each of the primary colors. With this arrangement, adjustments to the non-linear characteristics can be simultaneously made for each of the primary colors. When such a setting circuit is provided, a designation circuit for designating the resistance to be set by the setting circuit may also be preferably provided. The designation circuit may designate the resistance according to the detected temperature, or may read and designate the resistance from prestored resistances according to the display mode.

The electro-optical apparatus may further include a memory for storing digital data defining the grayscale of the electro-optical device; a control circuit for reading the digital data from the memory, and a D/A conversion circuit for converting the digital data read by the control circuit into a current signal indicating a current corresponding to the digital data, and for allowing the current signal to flow in the first transistor of the current generating circuit.

The electro-optical device of the electro-optical apparatus may preferably be an organic electro luminescence device.

An electronic unit of the present invention may preferably include the above-described electro-optical apparatus.

Thus, while this invention has been described in conjunction with specific embodiments thereof, it is evident that many alternatives, modifications, and variations will be apparent to those skilled in the art. Accordingly, preferred embodiments of the invention as set forth herein are intended to be illustrative not limiting. Various changes may be made without departing from the spirit and scope of the invention.

BRIEF DESCRIPTION OF THE DRAWINGS

The invention will be described with reference to the accompanying drawings, wherein like numerals reference like elements, and wherein:

FIG. 7 illustrates an equation expressing the characteristic of the same current generating circuit;

FIG. 8 illustrates an equation expressing the characteristic of the same current generating circuit;

FIG. 9 illustrates an equation expressing the characteristic of the same current generating circuit;

DETAILED DESCRIPTION OF PREFERRED EMBODIMENTS

Figure 1:
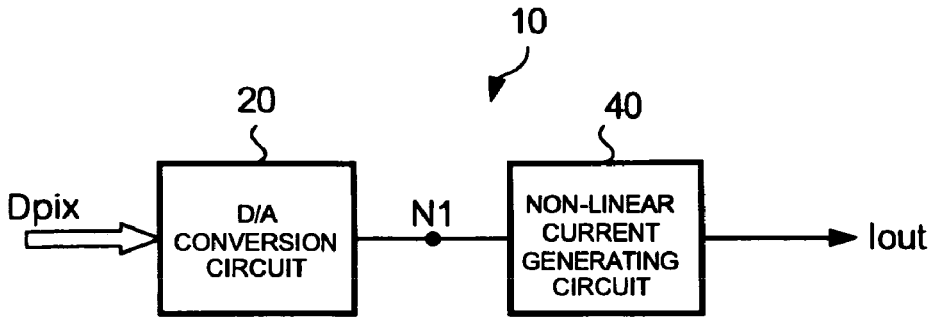
FIG. 1 illustrates the configuration of a current generating circuit according to an embodiment of the present invention.

An embodiment of the present invention is described below with reference to the drawings. FIG. 1 illustrates the configuration of an exemplary current generating circuit according to an embodiment.

As shown in FIG. 1, a current generating circuit 10 can include a D/A conversion circuit 20 for receiving digital data Dpix that linearly defines the grayscale of pixels so as to generate a current signal exhibiting linear characteristics for the digital data Dpix, and also includes a non-linear current generating circuit 40 for converting this current signal into a current signal exhibiting non-linear characteristics and outputting this current signal.

For the sake of description, it is now assumed that the digital data Dpix has 6 bits and defines the grayscale in 64 levels (two to the power of six) from "0" to "63" in decimal notation.

In this embodiment, the current generating circuit 10 is a combination of the D/A conversion circuit 20 and the non-linear current generating circuit 40. Only the non-linear current generating circuit 40 is, however, sometimes referred to as a current generating circuit (in a narrow sense).

Figure 2:
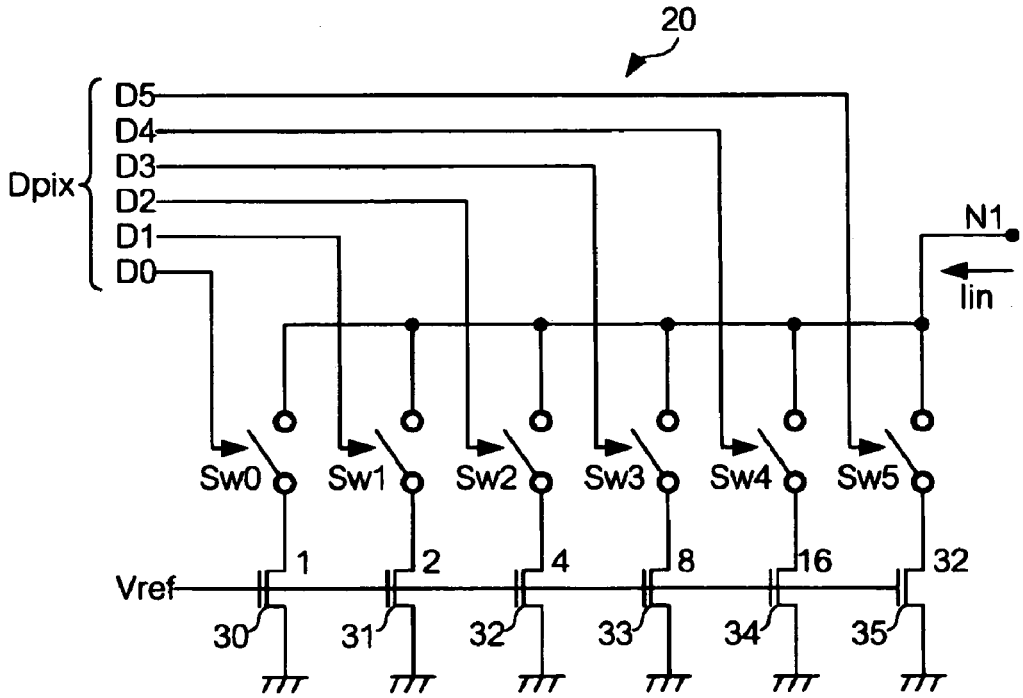
FIG. 2 illustrates the configuration of a D/A conversion circuit in the same current generating circuit.

In the current generating circuit 10, reference is first made to the D/A conversion circuit 20. FIG. 2 is an exemplary circuit diagram illustrating the configuration of the D/A conversion circuit 20.

In FIG. 2, a switch Sw0 is turned ON when the lowest bit D0 of the digital data Dpix is '1' and is turned OFF when the digital data Dpix is '0'. Similarly, switches Sw1 through Sw5 are turned ON when the fifth bit D1, the fourth bit D2, the third bit D3, the second bit D4, and the highest bit D5 of the digital data Dpix are '1', respectively, and are turned OFF when the corresponding bits are '0'.

One end of each of the switches Sw0 through Sw5 is connected to a common terminal N1, and the other end of the switch Sw0 is connected to the drain (electrode) of a transistor 30. Similarly, the other ends of the switches Sw1 through Sw5 are connected to the drains of transistors 31 through 35, respectively. The sources (electrodes) of the transistors 30 through 35 are grounded, i.e., they are connected to a common terminal to which the low-potential voltage of a power supply voltage is supplied.

Figure 3:
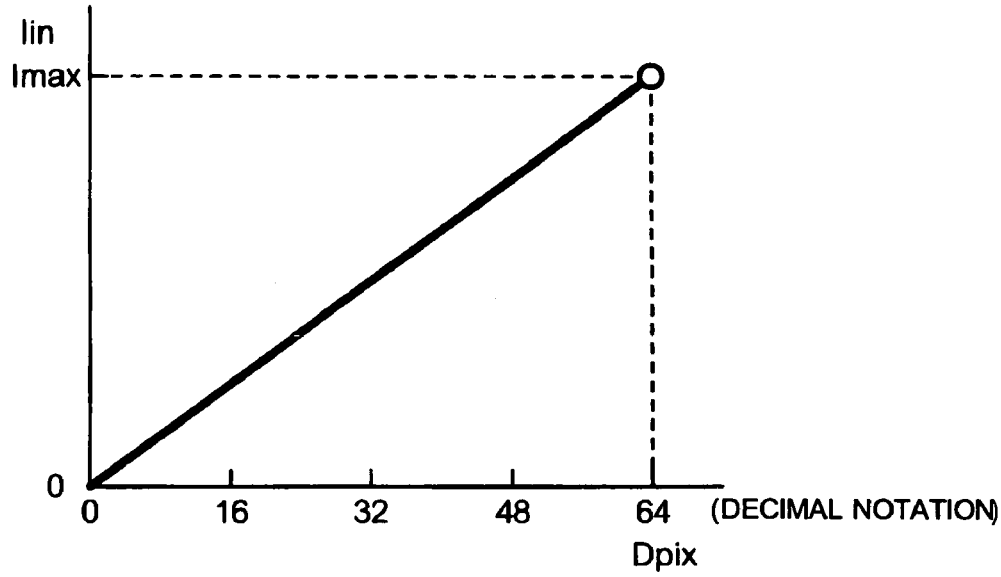
FIG. 3 illustrates an input/output characteristic of the same D/A conversion circuit.

A common reference voltage Vref is applied between the gates and the sources of the transistors 30 through 35. Accordingly, when each transistor is operated in a saturation area, the current flowing between the source and the drain of the transistor is determined by a gain coefficient (current amplification factor) β. When the ratio of the gain coefficient β of the transistors 30 through 35 is set to be 1:2:4:8:16:32, respectively, the current Iin flowing in the terminal N1 becomes the sum of the currents flowing in the transistors 30 through 35, and thus exhibits the characteristic shown in FIG. 3.

In other words, the current Iin takes 0 when the digital data Dpix is minimum "0" (decimal notation), and linearly (strictly speaking, discretely) increases until Imax when the digital data Dpix increases to the maximum value "63".

Figure 4:
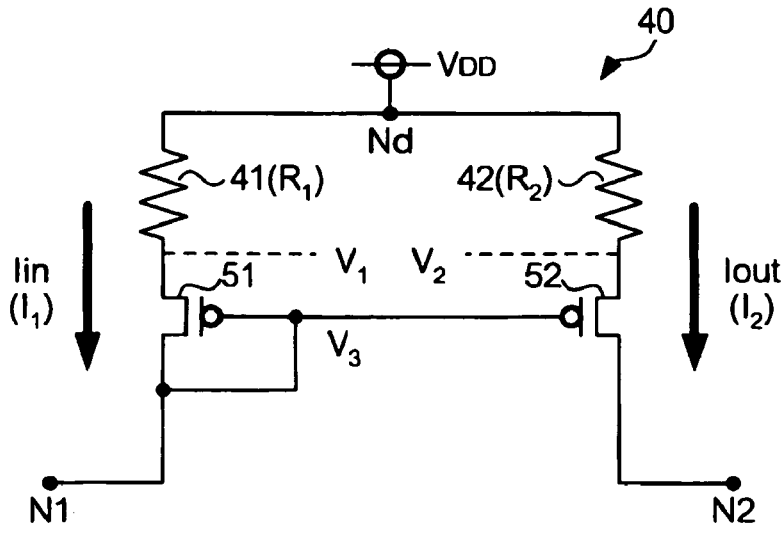
FIG. 4 illustrates the configuration of a non-linear current generating circuit in the same current generating circuit.

The non-linear current generating circuit 40 is now described. FIG. 4 is an exemplary circuit diagram illustrating the configuration of the non-linear current generating circuit 40. As shown in FIG. 4, the non-linear current generating circuit 40 includes resistors 41 and 42 and p-channel transistors 51 and 52, and forms a current mirror circuit for converting the linear current Iin ($I_1$) flowing in the terminal N1 into a non-linear current Iout ($I_2$) so as to supply the non-linear current Iout to a terminal N2.

One end of the resistor 41 and one end of the resistor 42 are connected to a common terminal Nd to which the high-potential voltage $V_{DD}$ of the power supply source is supplied. The source of the transistor 51 is connected to the other end of the resistor 41, and the gate and the drain of the transistor 51 are connected with each other in a saturating manner. The source of the transistor 52 is connected to the other end of the resistor 42, the gate thereof is connected to the gate of the transistor 51, which is connected to the drain thereof in a saturating manner at the transistor 41, and the drain of the transistor 52 is connected to the terminal N2.

Although the transistors 30 through 35, 51, and 52 are assumed FETs in this embodiment, it should be understood that they may also be bipolar transistors, and are not restricted to a particular transistor type.

It is now assumed that the voltage of the source of the transistor 51 (the other end of the resistor 41) is $V_1$, the voltage of the source of the transistor 52 (the other end of the resistor 42) is $V_2$, the voltage of the gate of the transistor 51 (the gate of the transistor 52) is $V_3$, the gain coefficient of the transistor 51 is $\beta_1$, the gain coefficient of the transistor 52 is $\beta_2$, the threshold voltage of the transistors 51 and 52 is $V_{th}$, the resistance of the resistor 41 is $R_1$, and the resistance of the resistor 42 is $R_2$. In this case, if the current flowing in the transistor operating in the saturation area is determined by the square law of the gate-source voltage, the currents $I_1$ and $I_2$ can be expressed by equations (1) and (2), respectively.

$$I_1=\{\beta_1(V_1-V_3-V_{th})^2\}/2 \tag{1}$$

$$I_2=\{\beta_2(V_2-V_3-V_{th})^2\}/2 \tag{2}$$

The voltage drops of the resistors 41 and 42 can be expressed by equations (3) and (4), respectively.

$$I_1 \cdot R_1=V_{DD}-V_1 \tag{3}$$

$$I_2 \cdot R_2=V_{DD}-V_2 \tag{4}$$

Equation (1) can be modified as follows.

$$(2I_1/\beta_1)^{1/2}=V_1-V_3-V_{th} \tag{5}$$

By eliminating the term $V_{DD}$ by using equations (3) and (4) and by solving equations (3) and (4) with respect to $V_1$, equation (6) can be determined.

$$V_1=V_2-I_1 \cdot R_1+I_2 \cdot R_2 \tag{6}$$

Figures 5, 6:
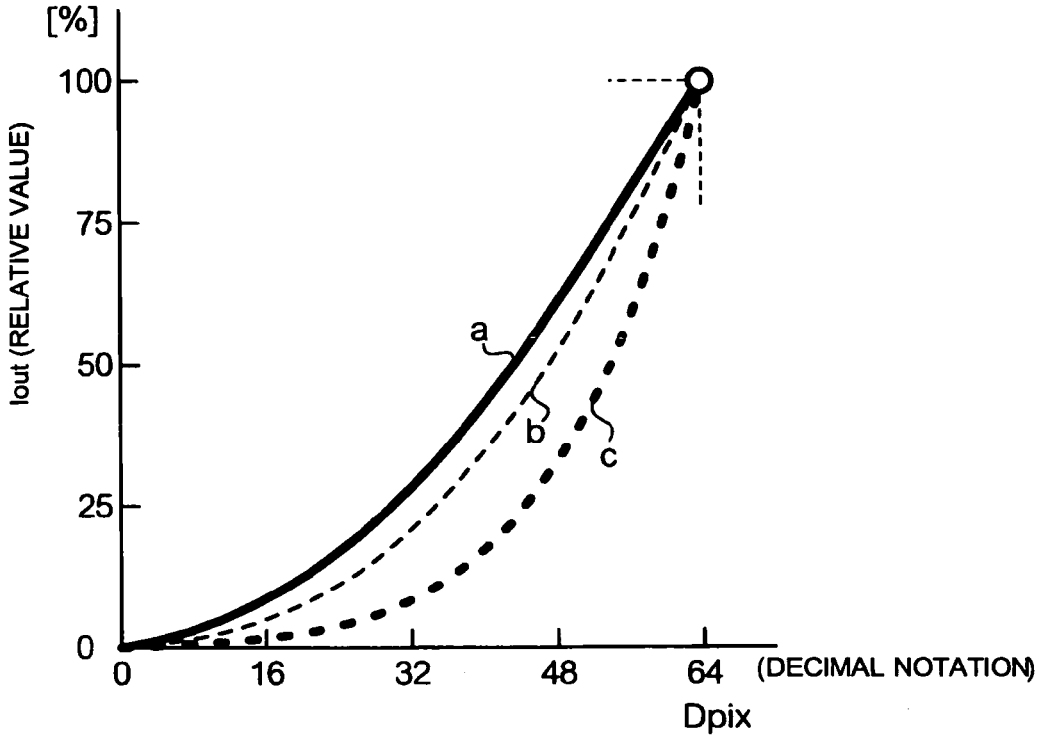
FIG. 5 illustrates an input/output characteristic of the same current generating circuit.
FIG. 6 illustrates an equation expressing the characteristic of the same current generating circuit.

Then, by substituting $V_1$ expressed in equation (6) into $V_1$ at the right side of equation (5), equation (7) can be determined, as shown in FIG. 6. Then, when the left side of equation (7) is substituted into the term within the parenthesis at the right side of equation (2), and then, the resulting equation is rearranged, as shown in FIG. 7, equation (8) is obtained.

Equation (8) is solved with respect to $I_2$, resulting in equation (9) shown in FIG. 8.

In FIG. 4, for differentiating the resistors 41 and 42, it is sufficient that the resistances thereof are different, and accordingly, it is sufficient that the line width or the line length of the resistors 41 and 42 is different. If the resistance of the resistor 41 is not zero, the resistance of the resistor 42 may be zero.

Then, for simplifying the characteristic indicated by equation (9), the terminal Nd and the source of the transistor 52 is short-circuited so that the resistance $R_2$ of the resistor 42 becomes zero. Then, equation (9) is simplified into equation (10) shown in FIG. 9.

In equation (10), the output current $I_2$ is expressed by a square function of the input current $I_1$, and thus, the characteristic of the output current $I_2$ in relation with the digital data Dpix can be indicated by sign a of FIG. 5. In FIG. 5, the output current $I_2$ is normalized as the relative current Iout in such a manner that it is 0% when the digital data Dpix is minimum "0" and it is 100% when the digital data Dpix is maximum "63".

As described above, according to this embodiment, the characteristic a of the output current $I_2$ (Iout) can be smooth, non-linear with respect to the digital data Dpix. The characteristic a can be approximated to a characteristic b (γ coefficient 2.2) which is considered to be ideal in an electro-optical apparatus described below.

Figure 10:
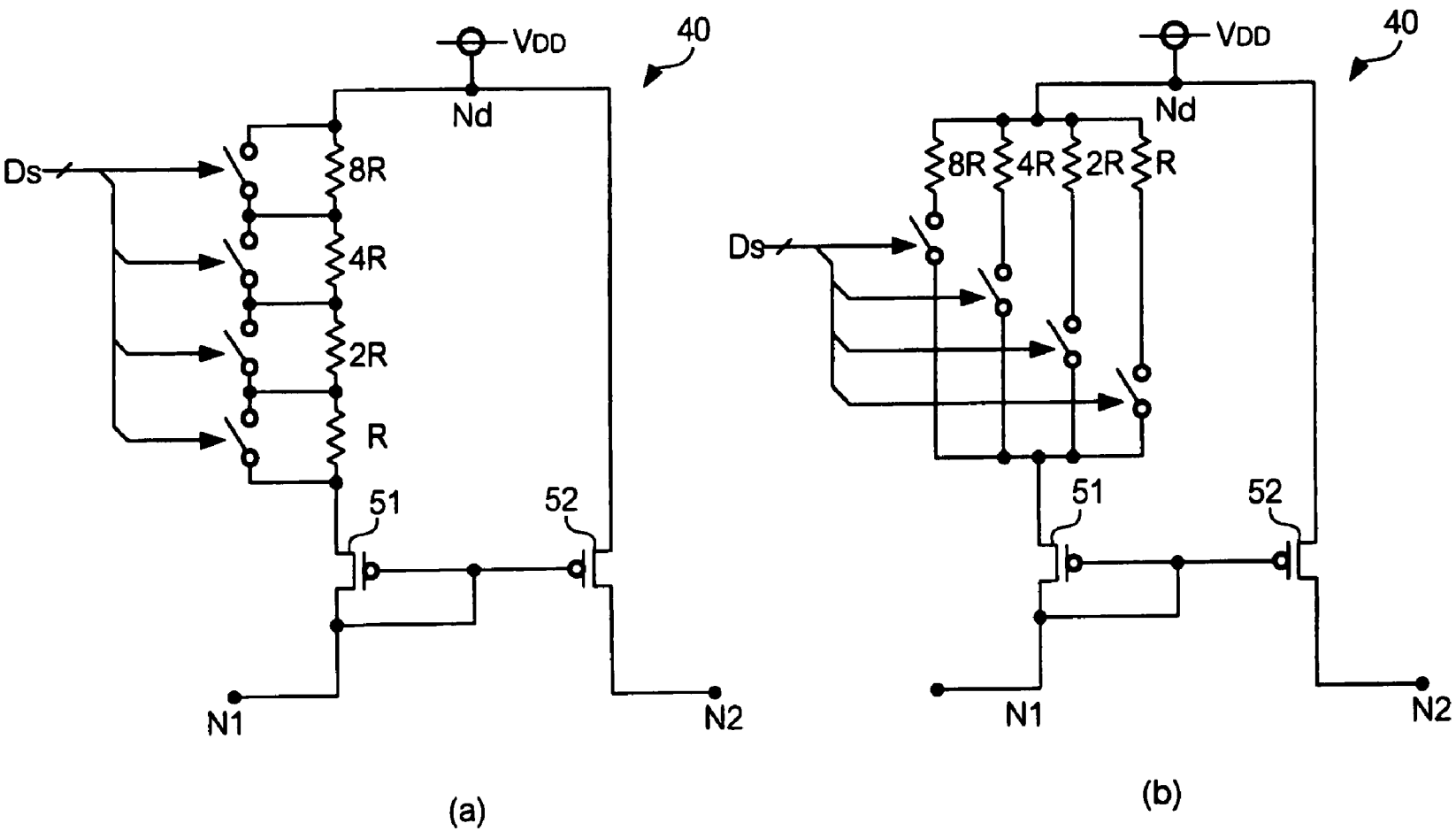
FIG. 10 illustrates examples of applications of the same current generating circuit.

In equation (10) in FIG. 9, since the resistance $R_1$ of the resistor 41 is a coefficient of the input current $I_1$, the rate by which the output current $I_2$ changes can be adjusted if the resistor 41 is a variable resistor. When the resistor 41 is set to be a variable resistor, for example, as shown in FIG. 10(*a*), instead of the resistor 41, an electronic volume consisting of a plurality of series-connected resistors and switches for turning ON or OFF across the corresponding resistors according to the bits of digital data Ds may be used. Alternatively, as shown in FIG. 10(*b*), an electronic volume having a plurality of parallel-connected resistors and switches for turning ON or OFF the connections of the corresponding resistors according to the bits of the digital data Ds may be used. By using such an electronic volume, the resistance $R_1$ as the combined resistance in accordance with the digital data Ds can be set from outside the current generating circuit 10, thereby making it possible to adjust the rate by which the output current $I_2$ changes.

Figure 11:
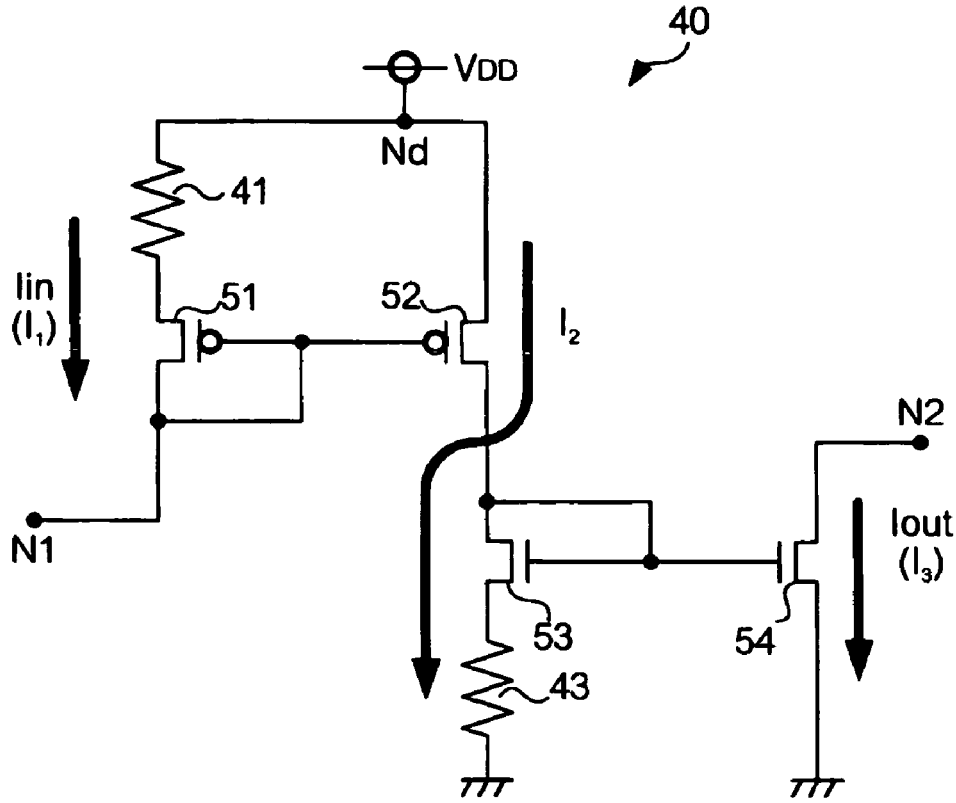
FIG. 11 illustrates an example of applications of the same current generating circuit.

Alternatively, as shown in FIG. 11, two or more current mirror circuits may be cascade-connected to form the non-linear current generating circuit 40. In FIG. 11, one end of a resistor 43 is grounded, and the other end thereof is connected to the source of an n-channel transistor 53 whose drain and gate are connected with each other in a saturating manner. The drain of the transistor 53 is connected to the drain of the transistor 52. The source of an n-channel transistor 54 is grounded, the drain thereof is connected to the terminal N2, and the gate thereof is connected to the gate (drain) of the transistor 53.

With this configuration, the output current $I_2$ is indicated by a square function of the input current $I_1$, and a current $I_3$ flowing in the transistor 54 via the terminal N2 is indicated by a square function of the current $I_2$. This means that the current $I_3$ is indicated by a biquadrate function of the input current $I_1$. Accordingly, the characteristic of the current $I_3$ (Iout) for the digital data Dpix is indicated by sign c of FIG. 5, in which the level of γ correction can be increased compared to that of the characteristic indicated by sign a.

Figure 12:
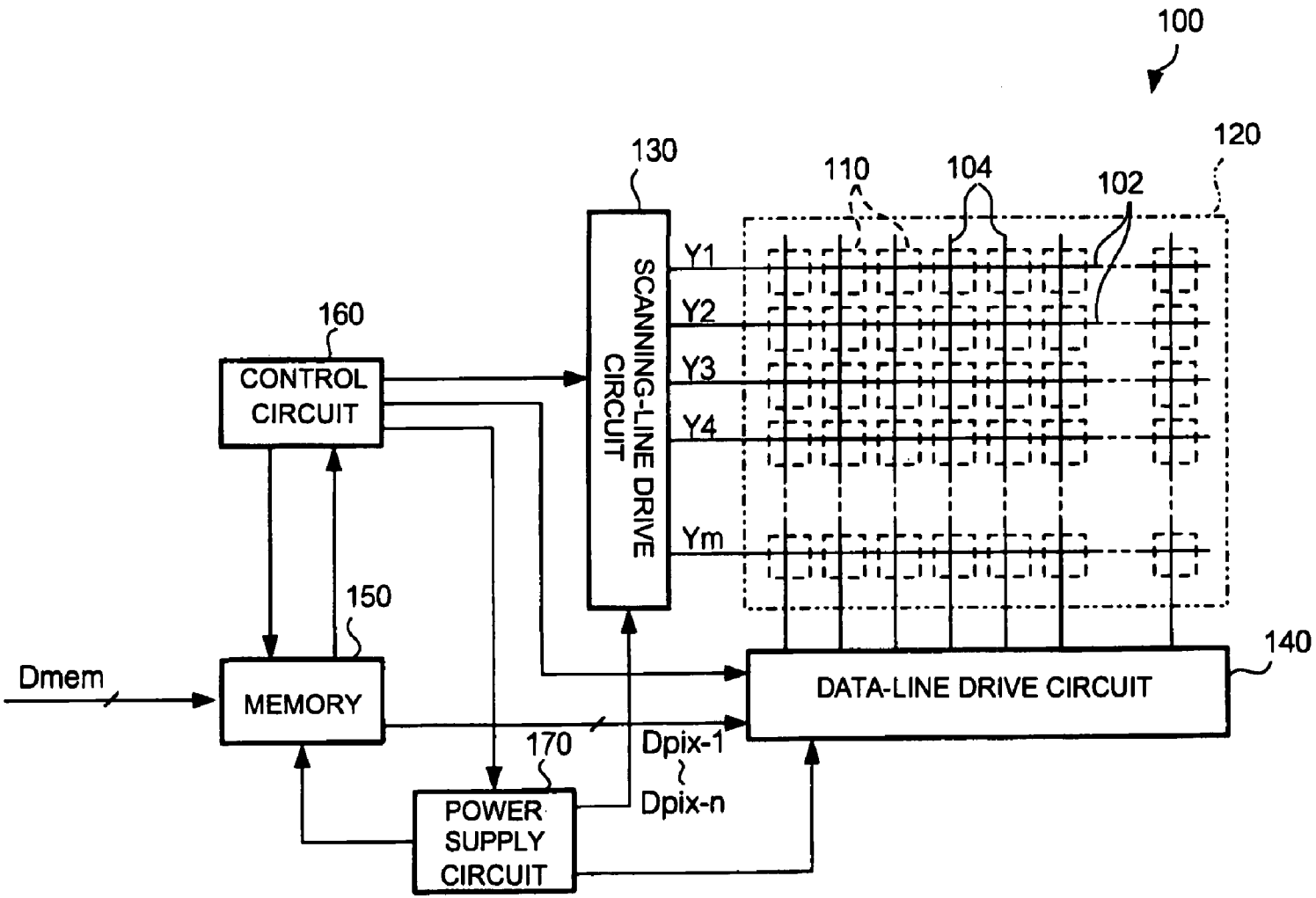
FIG. 12 illustrates an electro-optical apparatus to which the same current generating circuit is applied.

A description is now given of an electro-optical apparatus using the above-described current generating circuit 10. FIG. 12 is an exemplary block diagram illustrating the configuration of the electro-optical apparatus. As shown in FIG. 12, the electro-optical apparatus 100 includes a display panel 120 in which m scanning lines 102 and n data lines 104 intersect with each other (they are electrically insulated from each other), a pixel circuit 110 being provided at each intersection of the scanning lines 102 and the data lines 104. The electro-optical apparatus 100 also includes a scanning-line drive circuit 130 for driving the individual scanning lines 102, a data-line drive circuit 140 for driving the individual data lines 104, a memory 150 for storing digital data Dmem, supplied from an external device, for example, a computer, defining the grayscale level of each pixel forming an image to be displayed, a control circuit 160 for controlling all the elements, and a power supply circuit 170 for supplying power to all the elements.

In the electro-optical apparatus 100, too, it is assumed that the digital data Dpix has 6 bits and defines the grayscale level of each pixel in 64 levels (two to the power of six) by one of "0" to "63" in decimal notation.

Figure 13:
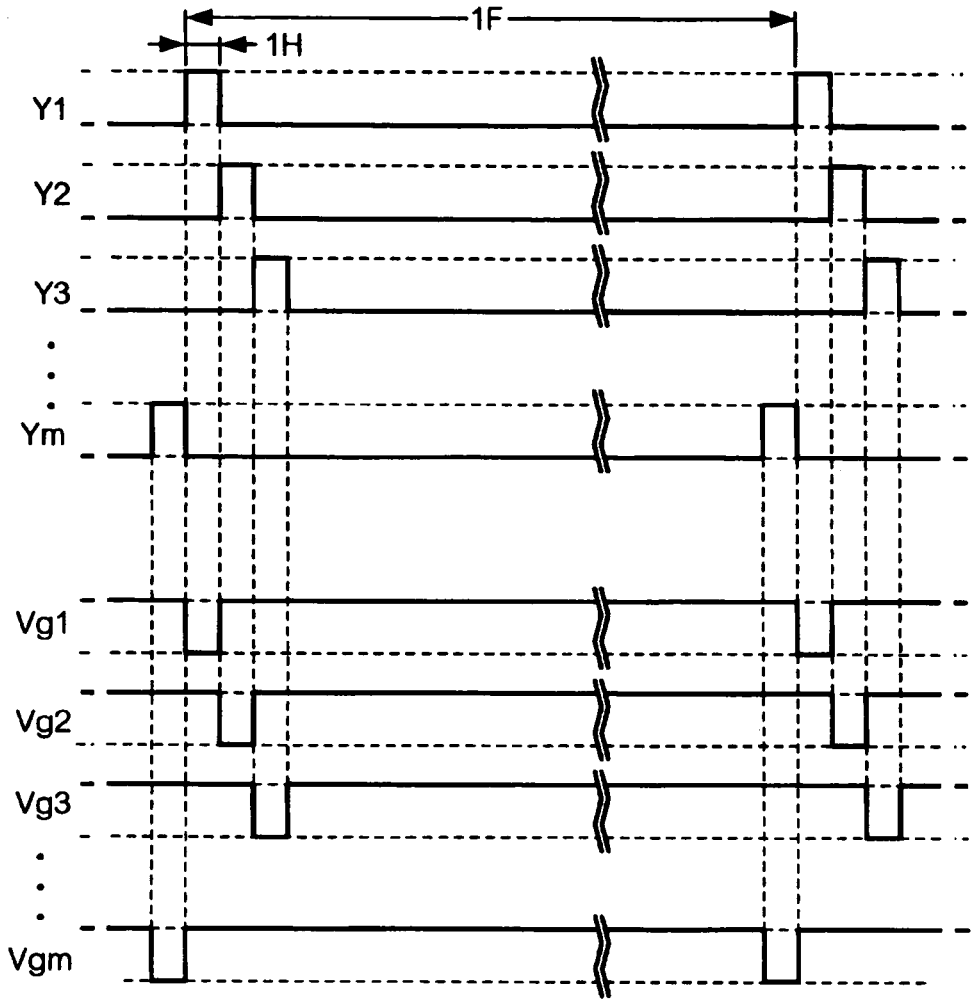
FIG. 13 illustrates the operation of a scanning-line drive circuit of the same electro-optical apparatus.

The scanning-line drive circuit 130 generates scanning signals Y1, Y2, Y3, . . . , Ym used for sequentially selecting the scanning lines 102 one by one. More specifically, as shown in FIG. 13, the scanning-line drive circuit 130 supplies a pulse having a width corresponding to one horizontal scanning period 12 (1H) to the first scanning line 102 as the scanning signal Y1 from the start of one vertical scanning period (1F), and then sequentially shifts this pulse to supply the scanning signals Y2, Y3, . . . , Ym to the second, third, . . . , m-th scanning lines 102, respectively. Generally, when the scanning signal Yi supplied to the i-th scanning line 102 (i is an integer satisfying $1 \leqq i \leqq m$) becomes H level, it means that the i-th scanning line 102 has been selected.

In addition to the scanning signals Y1, Y2, Y3, . . . , Ym, the scanning-line drive circuit 130 also generates signals having logical levels inverted from those of the scanning lines Y1, Y2, Y3, . . . , Ym as light-emission control signals Vg1, Vg2, Vg3, . . . , Vgm, and supplies them to the display panel 120. Signal lines through which the light-emission control signals are supplied are not shown in FIG. 12.

The control circuit 160 controls the scanning-line drive circuit 130 to select the scanning lines 102. Also, in synchronization with the selection of the scanning lines 102, the control circuit 160 reads the digital data Dpix-1 through Dpix-n corresponding to the first through n-th data lines 104 from the memory 150 and supplies them to the data-line drive circuit 140.

Figure 14:
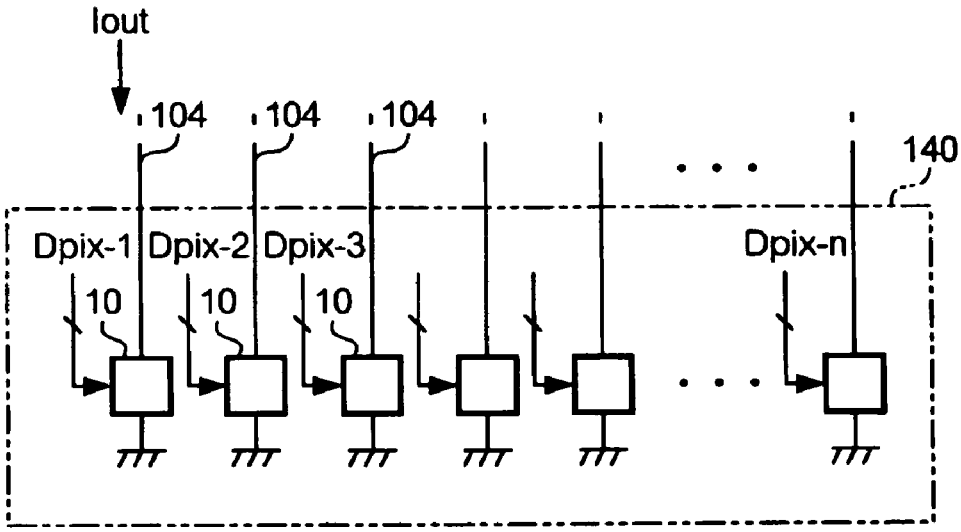
FIG. 14 illustrates a data-line drive circuit of the same electro-optical apparatus.

As shown in FIG. 14, the data-line drive circuit 140 has the current generating circuit 10, which is the feature of this invention, for each data line 104. Generally, digital data Dpix-j corresponding to the intersection of the selected scanning line 102 and the j-th data line 104 (j is an integer satisfying $1 \leqq j \leqq n$) is supplied to the j-th current generating circuit 10. In this electro-optical apparatus 100, the j-th current generating circuit 10 is, for example, a combination of the D/A conversion circuit 20 shown in FIG. 2 and the non-linear current generating circuit 40 shown in FIG. 11, and generates the non-linear current Iout for the supplied digital data Dpix-j and allows the current Iout to flow in the corresponding j-th data line 104. For example, the third current generating circuit 10 generates the current Iout corresponding to the value of the digital data Dpix-3 at the intersection of the selected scanning line 102 and the third data line 104, and allows the current Iout to flow in the third data line 104.

It should be understood that various modes can be considered to implement the commercial availability of the electro-optical apparatus 100. For example, the elements 120, 130, 140, 150, 160, and 170 of the electro-optical apparatus 100 maybe formed of independent components, or part of or all of the elements may be integrally formed (for example, the scanning-line drive circuit 130 and the data-line drive circuit 140 may be integrally formed, or part of or all of the elements except for the display panel 120 may be formed as a programmable IC chip, and the functions of the elements are implemented by a software program written into the IC chip).

Figure 15:
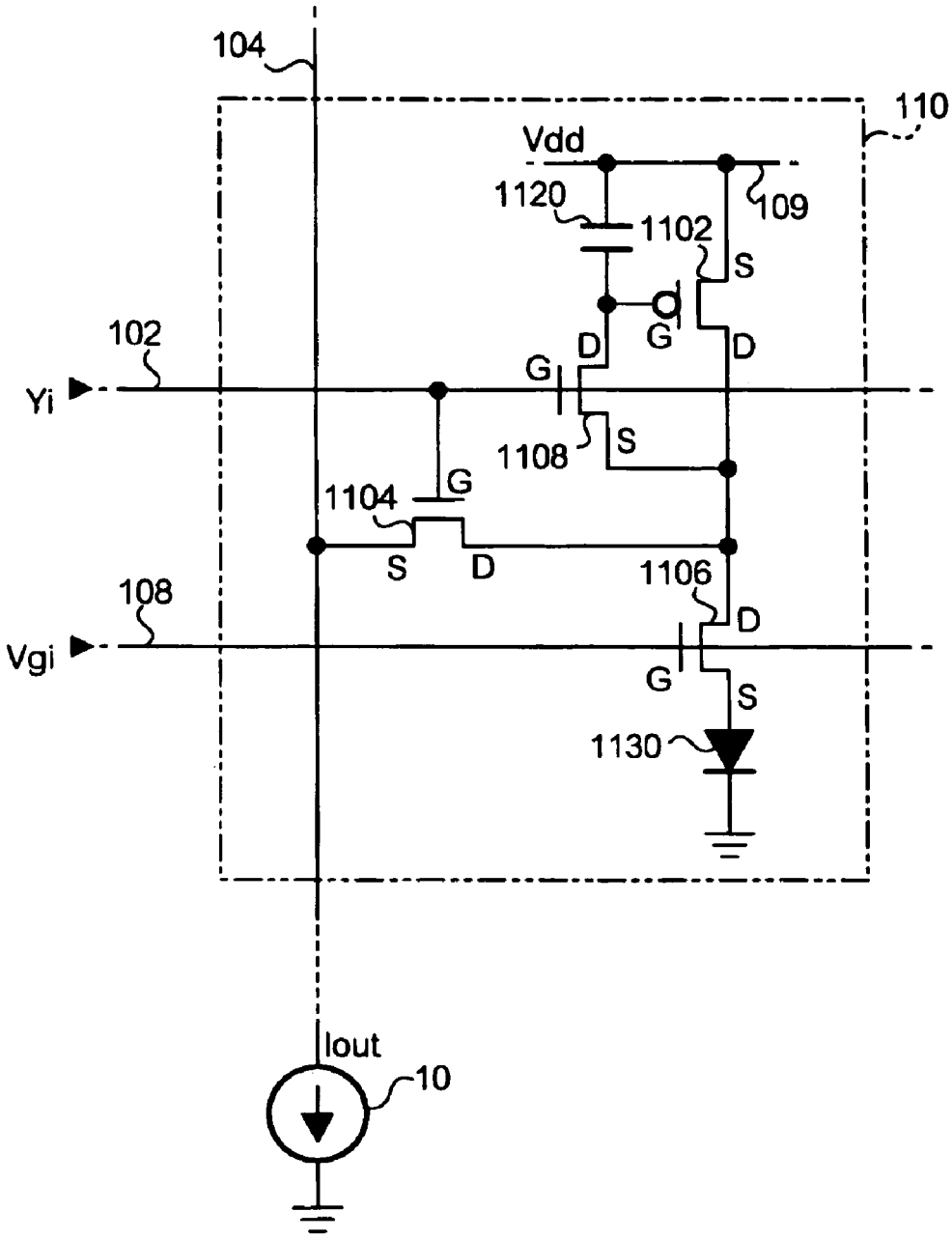
FIG. 15 illustrates a pixel circuit of the same electro-optical apparatus.

The pixel circuits 110 of the electro-optical apparatus 100 are as follows. FIG. 15 is an exemplary circuit diagram illustrating an example of the configuration of the pixel circuit 110. The structures of all the pixel circuits 110 are the same, and to describe the pixel circuit 110 by generalizing the scanning lines, the pixel circuit 110 provided at the intersection of the i-th scanning line 102 and a certain data line 104 is now discussed.

As shown in FIG. 15, the pixel circuit 110 provided at the intersection of the scanning line 102 and the data line 104 includes four thin film transistors (hereinafter simply referred to as "TFTs") 1102, 1104, 1106, and 1108, a capacitor device 1120, and an organic EL device 1130.

The source of the p-channel TFT 1102 is connected to a power supply line 109 to which a high-potential voltage Vdd of the power supply source is applied, and the drain thereof is connected to the drain of the n-channel TFT 1104, the drain of the n-channel TFT 1106, and the source of the n-channel TFT 1108.

One end of the capacitor device 1120 is connected to the power supply line 109 and the other end thereof is connected to the gate of the TFT 1102 and the drain of the TFT 1108. The gate of the TFT 1104 is connected to the scanning line 102 and the source thereof is connected to the data line 104. The gate of the TFT 1108 is connected to the scanning line 102.

The gate of the TFT 1106 is connected to a light-emission control line 108, and the source thereof is connected to the anode of the organic EL device 1130. The light-emission control signal Vgi is supplied to the light-emission control line 108 by the scanning-line drive circuit 130. In the organic EL device 1130, an organic EL layer is disposed between the anode and the cathode so that light is emitted with a luminance level in accordance with the forward current. The cathodes of the organic EL devices 1130 in all the pixel circuits 110 are a common electrode, and are grounded to a low potential (reference potential) of the power supply source.

With this configuration, when the i-th scanning line 102 is selected so that the scanning signal Yi becomes H level, the n-channel TFT 1108 is conducted (ON) across the source and the drain, and thus, the TFT 1102 serves as a diode whose gate and drain are connected to each other. When the scanning signal Yi supplied to the scanning line 102 becomes H level, the n-channel TFT 1104 is also conducted as in the TFT 1108. Thus, the current Iout generated from the current generating circuit 10 flows in the order of the power supply line 109, the TFT 1102, the TFT 1104, and the data line 104, and also, the electrical charge in accordance with the gate potential of the TFT 1102 is stored in the capacitor device 1120.

Subsequently, when the selection of the i-th scanning line 102 is completed so that the scanning signal Yi becomes L level, the TFTs 1104 and 1108 become non-conducted (OFF). However, since the storage state of the electrical charge in the capacitor device 1120 does not change, the gate of the TFT 1102 is maintained at the voltage when the current Iout has flown.

When the scanning signal Yi becomes L level, the light-emission control signal Vgi becomes H level. Accordingly, the n-channel TFT 1106 is turned ON so that a current flows across the source and the drain of the TFT 1102 in accordance with the gate voltage. More specifically, this current flows in the order of the power supply line 109, the TFT 1102, the TFT 1106, and the organic EL device 1130. Thus, the organic EL device 1130 emits light with a luminance level in accordance with the current.

The current flowing in the organic EL device 1130 is determined by the gate voltage of the TFT 1102, and this gate voltage is the voltage maintained in the capacitor device 1120 when the current Iout has flown in the data line 104 by the H-level scanning signal. Accordingly, the current flowing in the organic EL device 1130 when the light-emission control signal Vgi becomes H level is substantially equal to the previous current Iout. Thus, even if there is a variation in the characteristics of the TFTs 1102 in the overall pixel circuits 110, the current having the same level can be supplied to the organic EL devices 1130 of the pixel circuits 110, thereby preventing a display image from being non-uniform, which would be caused by the above-described characteristic variation.

Only one pixel circuit 110 has been described. However, since the i-th scanning line 102 is shared by the n pixel circuits 110, an operation similar to the above-described operation is performed in the n pixel circuits 110 when the scanning signal Yi becomes H level.

The scanning signals Y1, Y2, Y3, . . . , Ym become sequentially H level exclusively, as shown in FIG. 13. Thus, in each pixel circuit 110, the gate voltage of the TFT 1102 is maintained at the voltage stored in the capacitor device 1120 when the current Iout flows in accordance with the grayscale level of the organic EL device 1130.

The channel types of TFTs 1102, 1104, 1106, and 1108 are not restricted to the types described above, and p-channel and n-channel TFTs may be suitably selected.

The reason for using the current generating circuit 10 shown in FIG. 11 in the data-line drive circuit 140 is as follows. Since, in the pixel circuit 110, the organic EL device 1130 is driven by the p-channel TFT 1102, a current must flow in the organic EL device 1130 by withdrawing a current from the pixel circuit 110 via the data line 104.

Accordingly, if the pixel circuit 110 is configured such that the organic EL device 1130 is driven by the n-channel TFT 1102, the current generating circuit 10 shown in FIG. 4, 10(*a*), or 10(*b*) can be used so that a current flows in the organic EL device 1130 by being supplied to the pixel circuit 110 via the data line 104.

In the electro-optical apparatus 100, the light-emission control signals Vg1, Vg2, Vg3, . . . , Vgm are supplied by the scanning-signal drive circuit 130 by inverting the logical levels of the scanning signals Y1, Y2, Y3, . . . , Ym. However, the light-emission control signals Vg1, Vg2, Vg3, . . . , Vgm may be supplied by a separate circuit, or the periods during which the light-emission control signals Vg1, Vg2, Vg3, . . . , Vgm become an active level (H level) may be decreased together.

When performing color display in an electro-optical apparatus, a typical configuration of the electro-optical apparatus is as follows. Three pixel circuits correspond to the three primary colors, such as R (red), G (green), and B (blue), so that they form one pixel of a display image. With this configuration, to adjust the color balance, R, G, and B organic EL devices must adjust the γ characteristics for the individual primary colors. It is sometimes necessary for electro-optical apparatuses to adjust and set the γ characteristics later according to the environments (the intensity of extraneous light, temperature, etc.), the signal format, or the display mode.

Figure 16:
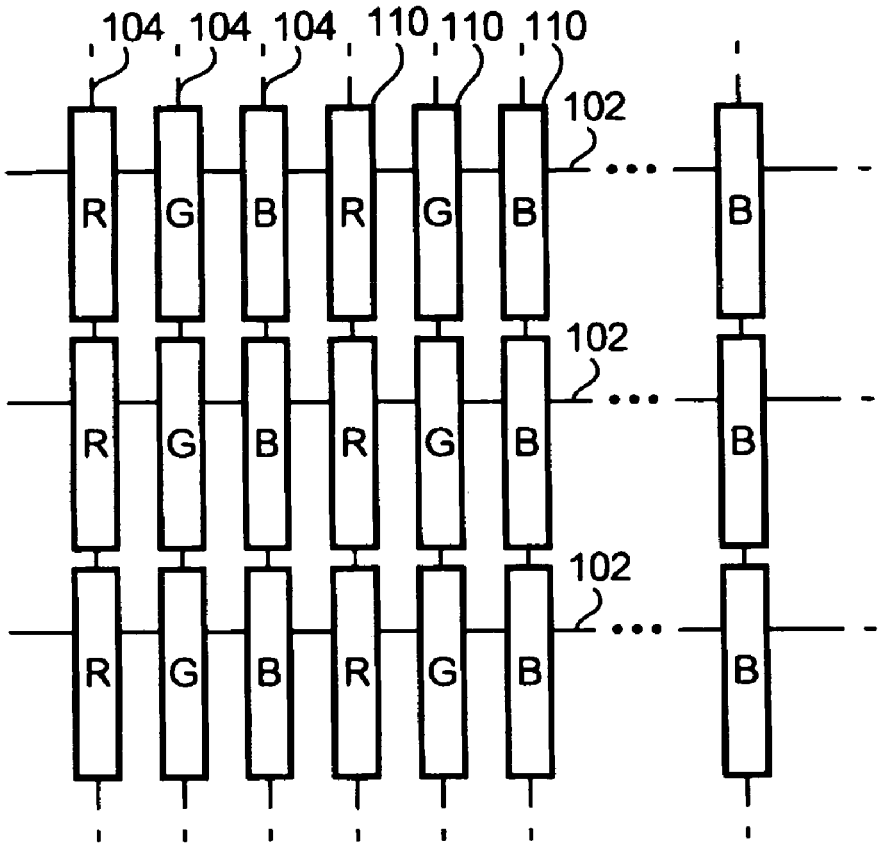
FIG. 16 illustrates the arrangement of the pixel circuits when color display is performed.

An electro-optical apparatus that satisfies such requirements is described below. FIG. 16 illustrates the arrangement of R, G, and B pixel circuits in the display panel 120 of this electro-optical apparatus. As shown in FIG. 16, the R, G, and B pixel circuits 110 are arranged in the form of a stripe in which the same color is disposed in one column (in the direction in which the data lines 104 are extended), and the pixel circuits 110 having the same color arranged in the same column share the same data line 104.

Figure 17:
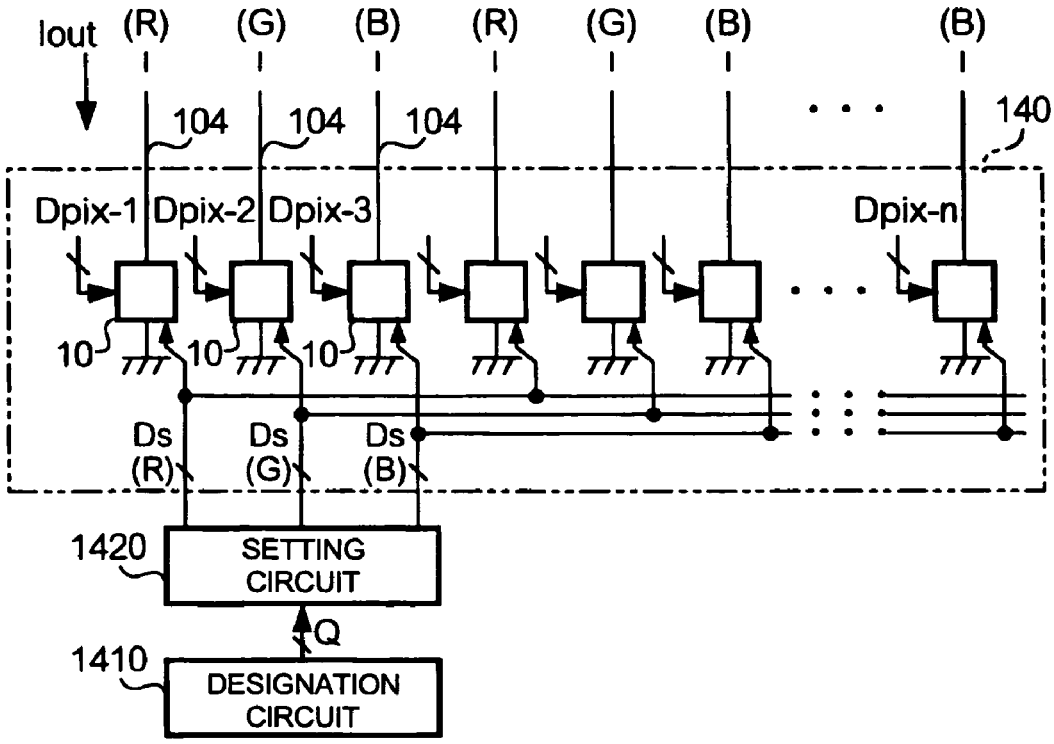
FIG. 17 illustrates an example of applications of the same data-line drive circuit.

FIG. 17 illustrates the configuration of the data-line drive circuit 140 of this electro-optical apparatus. The data-line drive circuit 140 shown here is similar to the configuration shown in FIG. 14 in that the current generating circuit 10 is provided for each data line 104. However, since the data lines 104 correspond to R, G, and B, the current generating circuits 10 are also associated with R, G, and B. In these current generating circuits 10, the resistor 41 of the non-linear current generating circuit 40 is a variable resistor, and the resistance thereof is set by an electronic volume, such as that shown in FIG. 10(*a*) or 10(*b*).

A designation circuit 1410 is a temperature sensor for detecting the temperature, an optical sensor for detecting the intensity of extraneous light, a determination circuit for determining the format of an image signal, or a switch for designating a display mode, and supplies information Q indicating a detection result, a determination result, or a designation content, to a setting circuit 1420.

The setting circuit 1420 generates digital data Ds according to the individual colors based on the information Q, and supplies the digital data Ds to the current generating circuits 10 of the corresponding colors. The digital data Ds can be generated from the information Q according to various techniques. For example, the digital data Ds can be computed by using a function using the information Q as an argument, or the information Q can be converted into the digital data Ds by using a preset table.

In the electro-optical apparatus constructed as described above, the non-linear characteristics of the current generating circuit 10 can be suitably adjusted for each of R, G, and B according to the environment, the mode, and the like.

Figure 18:
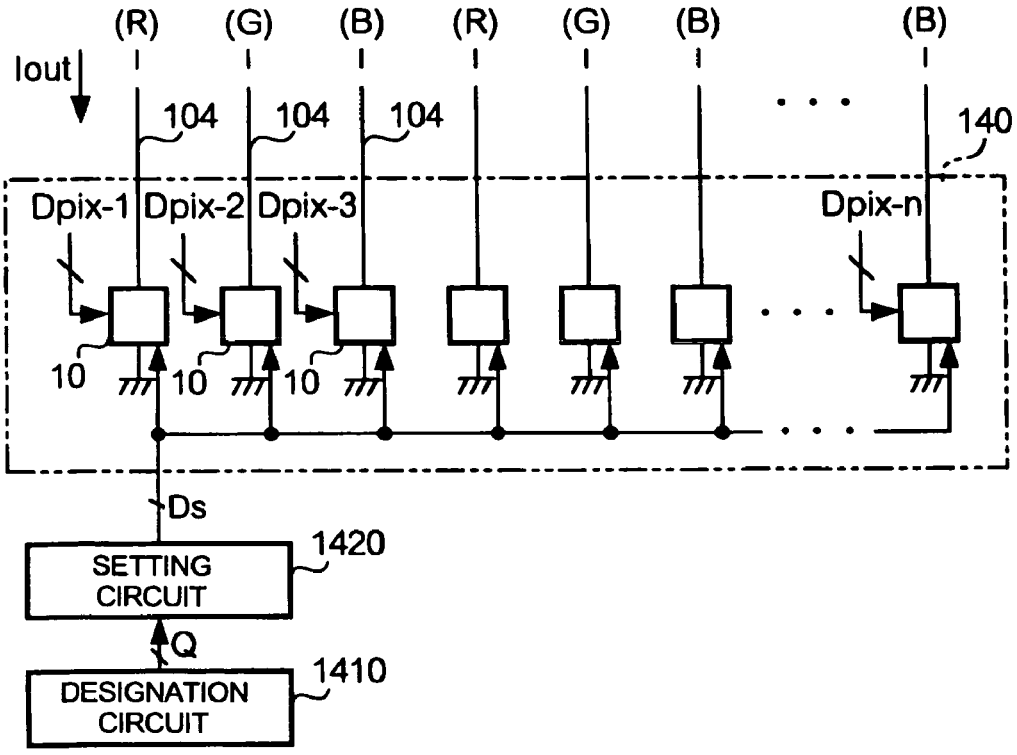
FIG. 18 illustrates an example of applications of the same data-line drive circuit.

If adjustments of the non-linear characteristics according to the environment, mode, and the like are not required for each of R, G, and B, the same digital data Ds can be used, as shown in FIG. 18. In this case, the circuit can be simplified compared to the configuration shown in FIG. 17.

Figure 19:
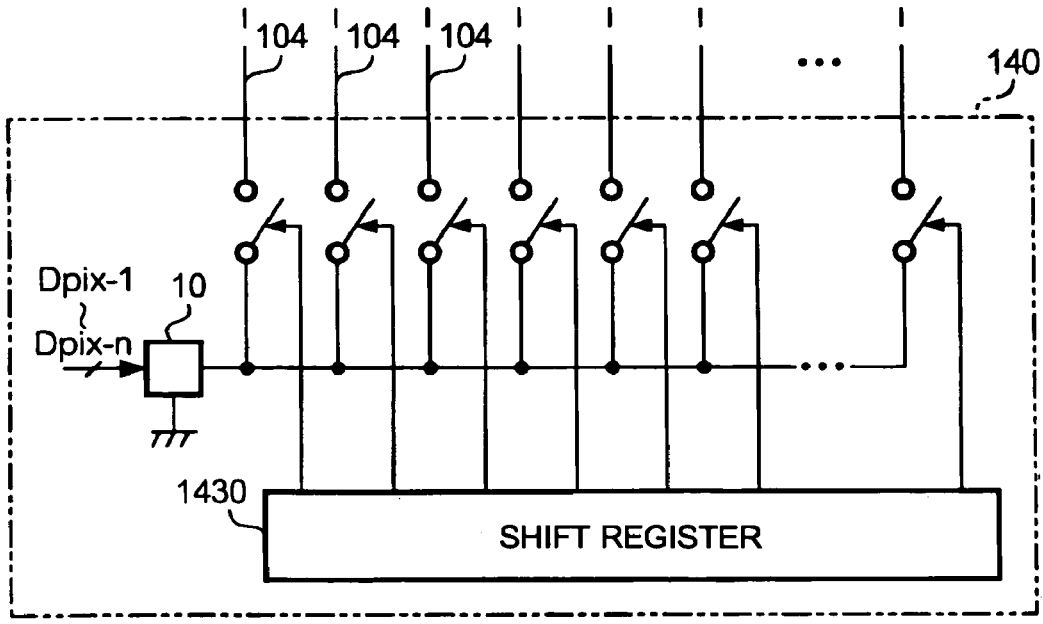
FIG. 19 illustrates an example of applications of the same data-line drive circuit.

Although the data-line drive circuit 140 shown in FIG. 14 or 17 has the current generating circuit 10 for each data line 104, it may be configured, such as that shown in FIG. 19. That is, in this configuration, a shift register 1430 sequentially selects the data lines 104 one by one during one horizontal period, and also, a current generated by the current generating circuit 10 flows in the selected data line 104 (dot-sequential system).

In the configuration of this dot-sequential system, too, color display may be performed, and the designation circuit 1410 and the setting circuit 1420 shown in FIG. 17 may be provided.

In the electro-optical apparatus 100 described above, the current generating circuit 10, which is the feature of the present invention, is used in the data-line drive circuit of an organic EL panel. However, the current generating circuit 10 may be used in various display panels other than the organic EL panels, for example, FED (Field Emission Display) panels.

Figure 20:
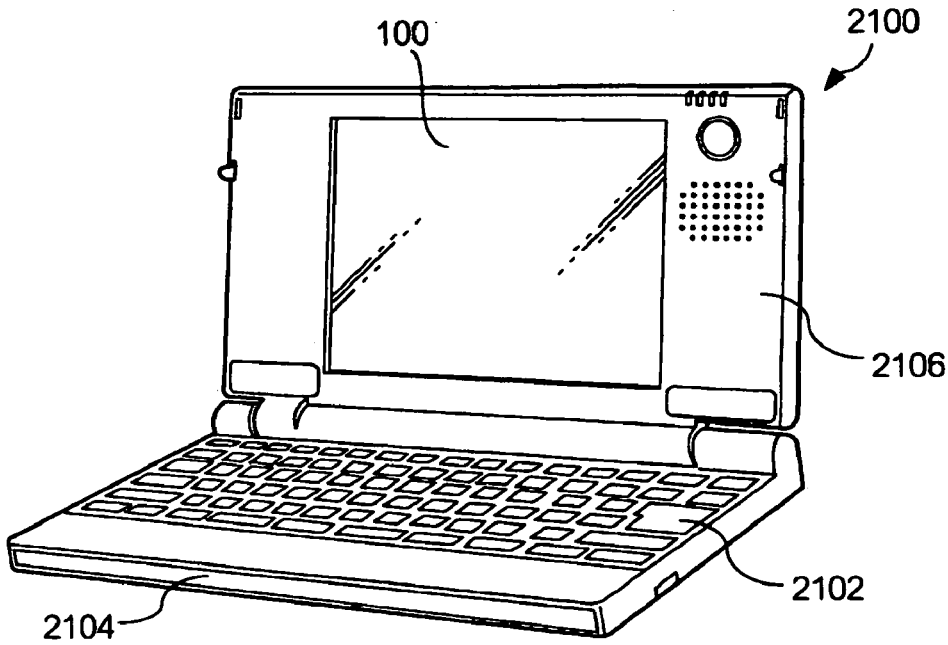
FIG. 20 illustrates a personal computer using the same electro-optical apparatus.

A description is now given of some examples of electronic units to which the electro-optical apparatus 100 is applied. FIG. 20 is a perspective view illustrating the configuration of a mobile personal computer to which the electro-optical apparatus 100 is applied. In FIG. 20, a personal computer 2100 includes a main unit 2104 provided with a keyboard 2102 and the electro-optical apparatus 100, which serves as a display unit.

Figure 21:
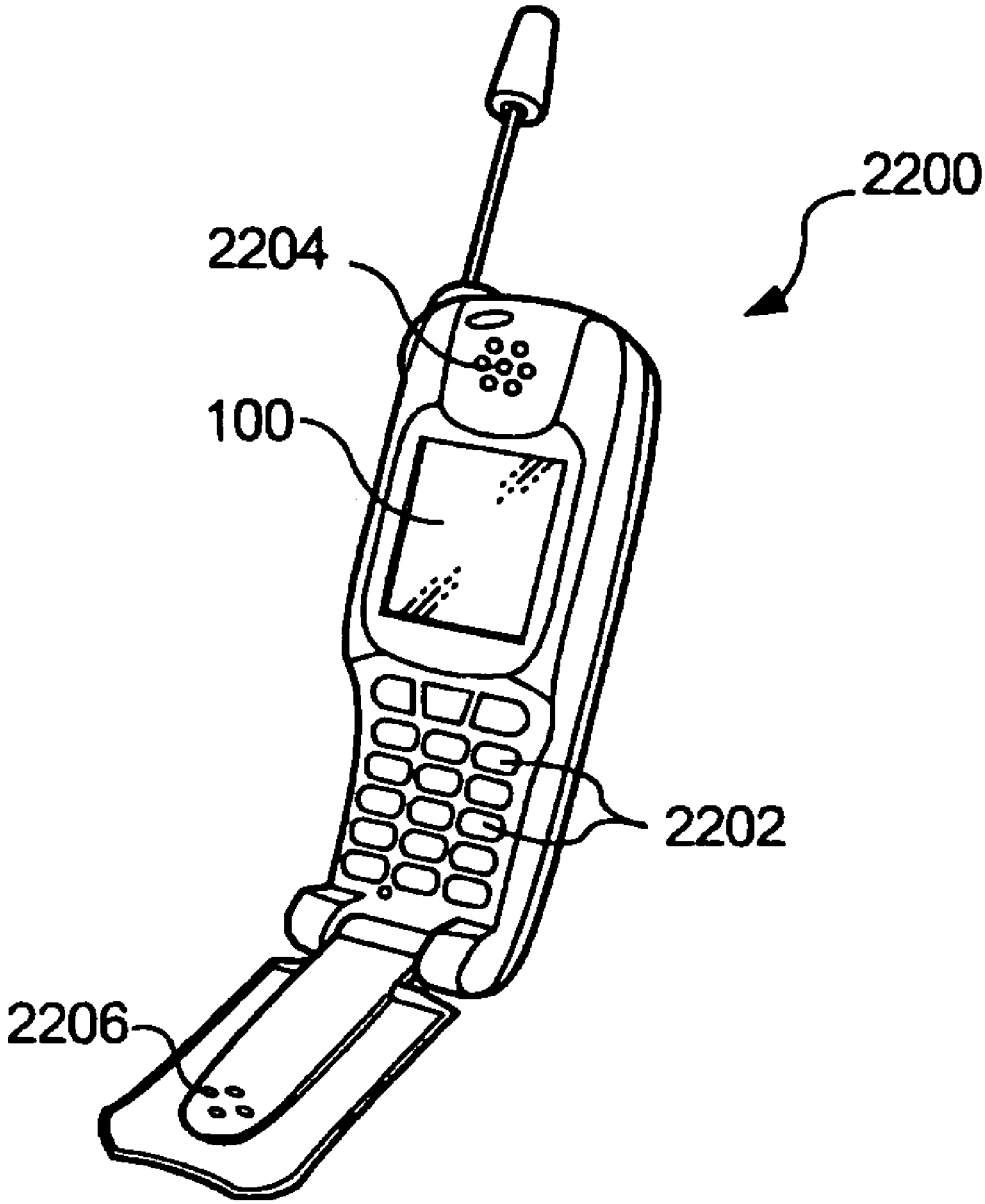
FIG. 21 illustrates a cellular telephone using the same electro-optical apparatus.

FIG. 21 is a perspective view illustrating the configuration of a cellular telephone to which the above-described electro-optical apparatus 100 is applied. In FIG. 21, a cellular telephone 2200 includes a plurality of operation buttons 2202, an earpiece 2204, a mouthpiece 2206, and the above-described electro-optical apparatus 100.

Figure 22:
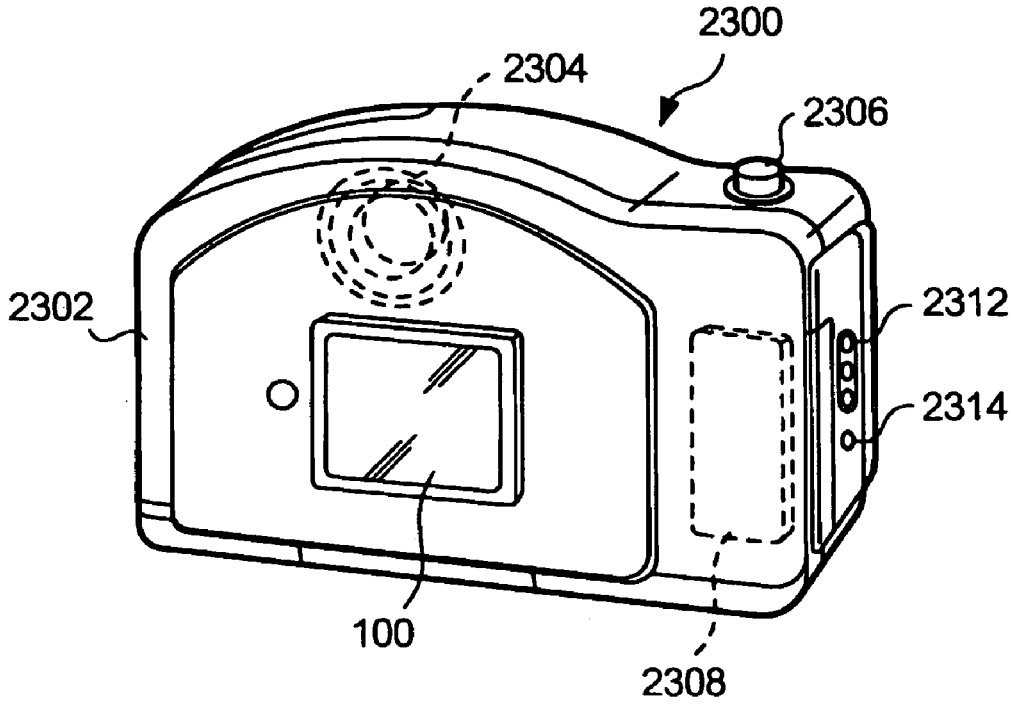
FIG. 22 illustrates a digital still camera using the same electro-optical apparatus.

FIG. 22 is a perspective view illustrating the configuration of a digital still camera having the above-described electro-optical apparatus 100 as a finder. In a silver-salt camera, a film is exposed to light by an optical image of a subject. In contrast, in a digital still camera 2300, an optical image of a subject is photo-electrically converted by an image-capturing device, for example, a CCD (Charge Coupled Device), so as to generate and store an image-captured signal. At the rear of a main unit 2302 of the digital still camera 2300, the above-described electro-optical apparatus 100 is disposed.

This electro-optical apparatus 100, which displays an image based on an image-captured signal, serves as a finder for displaying a subject. On the front surface (back surface in FIG. 22) of the main unit 2302, a light-receiving unit 2304 containing an optical lens, a CCD, etc., is provided.

After checking the subject image displayed on the electro-optical apparatus 100, a photographer presses a button 2306, and then, a CCD image-captured signal is transferred to and stored in a memory of a circuit board 2308.

In this digital still camera 2300, video-signal output terminals 2312 for external display and an input/output terminal 2314 for data communication are provided at a side surface of the main unit 2302.

It should be understood that electronic unit to which the electro-optical apparatus 100 is applied includes, not only the personal computer shown in FIG. 20, the cellular telephone shown in FIG. 21, and the digital still camera shown in FIG. 22, but also liquid crystal televisions, view-finder or monitor-direct-view-type display video cassette recorders, car navigation systems, pagers, digital diaries, calculators, word processors, workstations, videophones, POS terminals, devices provided with touch panels and the like. Of course, the above-described electro-optical apparatus 100 can be used as the display portion of these various electronic units.

Thus, while this invention has been described in conjunction with specific embodiments thereof, it is evident that many alternatives, modifications, and variations will be apparent to those skilled in the art. Accordingly, preferred embodiments of the invention as set forth herein are intended to be illustrative not limiting. Various changes may be made without departing from the spirit and scope of the invention.

What is claimed is:

1. An electro-optical apparatus, comprising:

pixel circuits disposed at intersections of a plurality of scanning lines and a plurality of data lines;

a scanning-line drive circuit that selects the scanning lines;

a data-line drive circuit, the pixel circuits having a plurality of types of pixel circuits corresponding to a plurality of primary colors, the data-line drive circuit being provided corresponding to the primary colors, and having a current generating circuit that supplies a current to a corresponding data line, the current generating circuit comprising:

a power supply terminal having a power supply voltage applied thereto;

a first resistor and a second resistor, one end of each of the first resistor and the second resistor being coupled to the power supply terminal, and a resistance of the first resistor and a resistance of the second resistor being different;

a first transistor that allows a current corresponding to a voltage of a gate of the first transistor to flow between a first terminal and a second terminal of the first transistor, the first terminal being coupled to another end of the first resistor, and the second terminal and the gate being coupled with each other; and a second transistor that allows a current corresponding to a voltage of a gate of the second transistor to flow between a first terminal and a second terminal of the second transistor, the first terminal being coupled to another end of the second resistor, and the gate of the second transistor being coupled to the gate of the first transistor; and the electro-optical apparatus further comprising a setting circuit that sets individually a resistance of at least one of the first resistor and the second resistor for each of the primary color.

2. The electro-optical apparatus according to claim 1, further comprising:

a plurality of current generating circuits, which include the current generating circuit, being dependently connected, a current that flows to the second transistor of one of the current generating circuits positioned in a front stage flowing to the first transistor of one of the current generating circuits positioned in a back stage.

3. The electro-optical apparatus according to claim 1, further comprising a D/A conversion circuit that converts digital data into a current signal indicating a current corresponding to digital data and that allows the current signal to flow in the first transistor.

4. An electro-optical apparatus according to claim 1, the pixel circuit having a capacitor device that stores electrical charge in accordance with the current flowing in the data line when the scanning line is selected by the scanning-line drive circuit; and an electro-optical device in which a current corresponding to an electrical charge stored in the capacitor device flows when selection of the scanning line is finished.

5. The electro-optical apparatus according to claim 1, the pixel circuits corresponding to the same primary colors being arranged using the same data line.

6. The electro-optical apparatus according to claim 5, further comprising:

a memory that stores digital data defining a grayscale of the electro-optical device;

a control circuit that reads the digital data from the memory; and a D/A conversion circuit that converts the digital data read by the control circuit into a current signal indicating a current corresponding to the digital data, and for allowing the current signal to flow in the first transistor of the current generating circuit.

7. The electro-optical apparatus according to claim 5, the electro-optical device being an organic electro luminescence device.

8. The electro-optical apparatus according to claim 1, in the current generating circuit, the current flowing in the first transistor being converted into a non-linear current flowing in the second transistor.

9. The electro-optical apparatus according to claim 1, further comprising a designation circuit that designates a resistance to be set by the setting circuit.

10. An electronic unit, in which the electro-optical apparatus as set forth in claim 1 is mounted.

11. An electro-optical apparatus, comprising:

pixel circuits disposed at intersections of a plurality of scanning lines and a plurality of data lines;

a scanning-line drive circuit that selects the scanning lines;

a data-line drive circuit, the pixel circuits having a plurality of types of pixel circuits corresponding to a plurality of primary colors, the data-line drive circuit being provided corresponding to the primary colors, and having a current generating circuit that supplies a current to a corresponding data line, the current generating circuit comprising:

a first resistor and a second resistor, one end of each of the first resistor and the second resistor being connected to a power supply terminal, a resistance of the first resistor and a resistance of the second resistor being different, and at least one of the first resistor and the second resistor being a variable resistor;

a first transistor that allows a current corresponding to a voltage of a gate of the first transistor to flow between a first terminal and a second terminal of the first transistor, the first terminal being coupled to the other end of the first resistor, and the second terminal and the gate being coupled with each other; and a second transistor that allows a current corresponding to a voltage of a gate of the second transistor to flow between a first terminal and a second terminal of the second transistor, the first terminal being coupled to the other end of the second resistor, and the gate of the second transistor being coupled to the gate of the first transistor; and the electro-optical apparatus further comprising a setting circuit that sets individually a resistance of at least one of the first resistor and the second resistor for each of the primary colors.

12. The electro-optical apparatus according to claim 11, only the first resistor of the first and second resistors is a variable resistor.

13. The electro-optical apparatus according to claim 11, the variable resistor being configured such that a plurality of resistor devices having predetermined resistances are coupled in series with each other.

14. The electro-optical apparatus according to claim 11, the variable resistor being configured such that a plurality of resistor devices having predetermined resistances are coupled in parallel with each other.

15. The electro-optical apparatus according to claim 11, further comprising:

a plurality of current generating circuits, which include the current generating circuit, being dependently connected, a current that flows to the second transistor of one of the current generating circuits positioned in a front stage flowing to the first transistor of one of the current generating circuits positioned in a back stage.

16. The electro-optical apparatus according to claim 11, further comprising a D/A conversion circuit that converts digital data into a current signal indicating a current corresponding to digital data and that allows the current signal to flow in the first transistor.

* * * * *